US007593670B2

(12) United States Patent
Matsuda et al.

(10) Patent No.: US 7,593,670 B2
(45) Date of Patent: Sep. 22, 2009

(54) CHARGING DEVICE INCLUDING A CONTACT CHARGING MEMBER WITH SILICA THEREON, PROCESS CARTRIDGE INCLUDING A CONTACT CHARGING MEMBER, AND IMAGE FORMING APPARATUS INCLUDING SUCH CHARGING MEMBER

(75) Inventors: Kohei Matsuda, Shizuoka-ken (JP); Tetsuya Kobayashi, Numazu (JP); Masato Koyanagi, Mishima (JP); Shinichi Agata, Shizuoka-ken (JP); Shinya Yamamoto, Numazu (JP); Kentarou Kawata, Numazu (JP); Taku Watanabe, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/276,257

(22) Filed: Feb. 21, 2006

(65) Prior Publication Data

US 2006/0188292 A1 Aug. 24, 2006

(30) Foreign Application Priority Data

Feb. 22, 2005 (JP) ..... 2005-045457
Feb. 16, 2006 (JP) ..... 2006-039570

(51) Int. Cl.
*G03G 15/02* (2006.01)

(52) U.S. Cl. ..... 399/174

(58) Field of Classification Search ..... 399/174, 399/50; 430/108.6
See application file for complete search history.

(56) References Cited

U.S. PATENT DOCUMENTS 5,881,343 A * 3/1999 Momotani et al. ..... 399/174
6,600,887 B2 7/2003 Takami et al. ..... 399/174
7,356,278 B2 * 4/2008 Piotrowski et al. ..... 399/100
2002/0106512 A1 * 8/2002 Nakamura et al. ..... 428/404
2003/0194625 A1 * 10/2003 Tanaka et al. ..... 430/58.8
2004/0234881 A1 * 11/2004 Miyakawa et al. ..... 430/108.6
2005/0207778 A1 * 9/2005 Yamashita ..... 399/100

FOREIGN PATENT DOCUMENTS

JP 08006359 A * 1/1996
JP 09197768 A * 7/1997

OTHER PUBLICATIONS

"High Temperature Polymers for Microelectronics: Heat-Resistive High Polymer for Electronic Industry Material" pp. 88-90 and 100-101, and partial English-language translation, May 30, 2003.
Enplanet.com, "Market Trend of PI (polyimide) Films, 2004 Edition" and partial English-language translation.

* cited by examiner

*Primary Examiner*—Quana M Grainger
(74) *Attorney, Agent, or Firm*—Fitzpatrick, Cella, Harper & Scinto

(57) ABSTRACT

A charging device for electrically charging an image bearing member, includes a contact charging member contactable to the image bearing member to charge the image bearing member, the contact charging member being supplied only with a DC voltage; and a contact member contacted to the charging member, wherein the image bearing member is adapted to carry a toner image of toner which contains an externally added material comprising silica, wherein work functions of the charging member, the contact member and the silica satisfy, (the work function of the contact member)>(the work function of the silica)>(the work function of the charging member).

16 Claims, 7 Drawing Sheets

CHARGING DEVICE INCLUDING A CONTACT CHARGING MEMBER WITH SILICA THEREON, PROCESS CARTRIDGE INCLUDING A CONTACT CHARGING MEMBER, AND IMAGE FORMING APPARATUS INCLUDING SUCH CHARGING MEMBER

FIELD OF THE INVENTION AND RELATED ART

The present invention relates to a charging apparatus which charges an image bearing member such as an electrophotographic photosensitive member, an electrostatically recordable dielectric member, etc., by placing a charging member in contact with the image bearing member. It also relates to a process cartridge having such a charging apparatus. Further, it relates to an image forming apparatus which employs such a charging apparatus and an electrophotographic image forming method.

Here, "image forming apparatus employing an electrophotographic image forming method" means an apparatus which forms an image on recording medium (for example, recording paper, OHP sheet, etc.) with the use of an electrophotographic image forming method. As examples of an image forming apparatus, an electrophotographic copying machine, an electrophotographic printer (for example, laser printer, LED printer, etc.), a facsimileing machine, a wordprocessor, and a multi-functional machine (multifunctional printer, etc.) made up of the combination of the preceding apparatuses, can be included.

"Process cartridge" means a cartridge in which at least one among a charging apparatus, a developing apparatus, and a cleaning apparatus, and a photosensitive member as an image bearing member, are integrally disposed, and which is removably mountable in the main assembly of an image forming apparatus. Thus, "process cartridge" includes a cartridge in which at least a charging apparatus as a processing means, and an electrophotographic photosensitive drum are integrally disposed, and which is removably mountable in the main assembly of an image forming apparatus.

In an electrophotographic image forming apparatus, generally, the following processes are carried out: a charging process for charging a photosensitive drum as an image bearing member; an exposing process for forming an electrostatic latent image on a photosensitive drum with the use of an exposing means such as scanning a photosensitive drum with a beam of laser light; a developing process for developing an electrostatic latent image into a visible image, with the use of toner; a transferring process for transferring a toner image on a photosensitive drum, onto recording medium; a fixing process for fixing a toner image on recording medium; and a cleaning process for cleaning a photosensitive drum after a transferring process. An electrophotographic image is formed by sequentially carrying out these processes.

For the purpose of giving desired properties to toner, various external particulate additives are added to toner, causing external additive particles to adhere to the surface of a toner particle. The inherent polarity to which external additives become charged is the same as the inherent polarity to which toner becomes charged.

Charging apparatuses for charging a photosensitive drum can be roughly classified into two types: noncontact type and contact type.

A charging apparatus of the noncontact type generally employs a corona discharger, which is disposed next to a photosensitive drum, with no contact between the corona discharger and photosensitive drum. To the metallic wire (discharge wire) of the corona discharger, high voltage (5-8 kV of DC voltage) is applied to cause the wire to discharge corona, by which the peripheral surface of a photosensitive drum is charged.

A charging apparatus of the contact type is such a charging apparatus that charges the peripheral surface of the photosensitive drum by placing a charging member (which hereinafter may be be referred to as charge roller), for example, a charge roller, in contact with the photosensitive drum, and applying voltage to the charge roller. It is superior to a charging apparatus of the noncontact type in that it is lower in ozone emission, low in power consumption, etc.

Charging apparatuses of the contact type may be roughly classified into two groups, that is, a group of the so-called DC type, and a group of the so-called AC type. In the case of the DC type group, only DC voltage is applied to a charge roller to charge a photosensitive drum, whereas in the case of the AC type, the combination of DC voltage and AC voltage is applied to a charge roller to charge a photosensitive drum.

A charging method of the contact/DC type is advantageous over a charging method of the contact/AC type in that it does not produce charging noises and electrostatic noises, is lower in power source cost, is low in ozone emission, low in the overall cost, etc. Further, it is smaller in the amount of electric current involved with the electric discharge for charging the peripheral surface of a photosensitive drum to a preset potential level. In other words, its merits are substantial.

Generally, in the case of an image forming apparatus of the reversal development type, negative voltage is applied as bias to a charge roller, and a photosensitive drum is charged to negative polarity.

After the end of a transfer process, unwanted substances such as transfer residual toner, paper dust, etc., are present on a photosensitive drum. Thus, an image forming apparatus is designed so that these unwanted substances are removed through a cleaning process, in which they are scraped away with the use of a cleaning blade or the like, and stored in a waste toner bin. However, it is difficult to scrape away all the unwanted substances on a photosensitive drum through a cleaning process; a very small amount of the unwanted substances, for example, a very small amount of toner, etc., slips by a cleaning blade.

The small amount of residual toner, which has slipped by the cleaning blade, contains such toner particles that had been positively charged through a transfer process, and such toner particles that had been given a small amount of negative charge through a transfer process. These residual toner particles are given electric charge by the electrical discharge caused through the following charging process, acquiring therefore a certain amount of negative electric charge. Negatively charged residual toner particles are not likely to adhere to a charge roller. However, there are residual toner particles that were not given a sufficient amount of electrical charge, and these residual toner particles adhere to a charge roller.

These residual toner particles are likely to nonuniformly adhere to the peripheral surface of a charge roller, and the nonuniform adhesion of these residual toner particles to the peripheral surface of a charge roller is likely to make the charge roller nonuniform in surface properties. A charge roller which is nonuniform in surface properties is likely to nonuniformly charge a photosensitive drum in terms of potential level, creating the problem that an image suffering from defects attributable to the nonuniform charging of a photosensitive drum is yielded. This problem is more likely to occur when the charging method of the DC/contact type, which applies only DC voltage to a charge roller, is employed than when the charging method of the AC/contact type is employed.

Thus, in order to prevent the above described toner particle adhesion to a charging roller as a charging member of the contact type, from causing the charge roller to nonuniformly charge a photosensitive drum, such a technology has been proposed that a rubbing sheet is placed in contact with a charge roller to disperse the toner particles having adhered to the charge roller.

However, it has been discovered that even when the above described technology in accordance with the prior art is employed, a photosensitive drum is unsatisfactorily charged because the external additives of toner, which will be described later, adhere to the abovementioned member rubbing sheet and accumulate thereon. Thus, it has been desired to improve this technology.

To describe in more detail the abovementioned problem, toner contains various external additives which are in the form of a microscopic particle. These microscopic particles of the external additives are generally negatively charged particles as are the toner particles themselves. Further, they sometimes become separated from toner particles as they are put through a development process, a transfer process, and cleaning process. The occurrence of this phenomenon is sometimes rendered more conspicuous by such factors as the cumulative usage of an image forming apparatus which is required to be durable, type of external additive, condition under which toner is manufactured, etc. In addition, compared to the particle diameter of toner (roughly 6 μm in volume average diameter), the particle diameter of external additive is extremely small (roughly 0.01 μm in volume average diameter). Therefore, external additive is difficult to scrape away from the peripheral surface of a photosensitive drum with the use of a cleaning apparatus, sometimes slipping by the cleaning apparatus by a greater amount than the amount by which the residual toner slipped by the cleaning apparatus, and reaching a charge roller. As the external additive slips by a cleaning apparatus and reaches a charge roller, it is given electrical charge, which is the same in polarity as that given to toner, through a charging process. However, the substantial amount of the external additive having slipped by the cleaning apparatus receives an unsatisfactory amount of electric charge, being thereby rendered likely to adhere to a charge roller.

There has been observed the following phenomenon: As a charge roller is rotated, the external additive having adhered to a charge roller adheres to the abovementioned rubbing sheet as the external additive moves through the area in which the charge roller is in contact with the sheet. The severity of the additive adhesion to the sheet was affected by the additive type, and the material for the sheet. Besides, external additives are more likely to agglomerate than toner. Therefore, external additives continue to accumulate onto the body of external additives having adhered to the sheet, forming eventually microscopic projections on the sheet.

Once the microscopic projections are formed of external additives, on the sheet, they leave, on the peripheral surface of a charge roller, such scratches that extend in the circumferential direction of the charge roller, and/or prevent the rubbing sheet from evenly contacting the charge roller, preventing thereby the rubbing sheet from evenly dispersing the external additives having adhered to the charge roller. As a result, a photosensitive drum is unsatisfactorily charged across the areas which correspond to the abovementioned streaky scratches of the charge roller, causing thereby an image forming apparatus to yield an image suffering from image defects which extend in the vertical direction. The possibility of the formation of an image suffering from this image defect is much higher when the external additives include silica than otherwise.

The present invention is a further development of the above described technology in accordance with the prior art, and its primary object is to prevent the phenomenon that the additives of toner adhere to a charging member, transfer from the charging member to a particle dispersing member placed in contact with the charge roller, accumulating thereon, and cause the charging member to unsatisfactorily charge an object to be charged.

SUMMARY OF THE INVENTION

Accordingly, the object of the present invention is to provide a charging device, a process cartridge and an image forming apparatus, wherein occurrence of improper charging attributable accumulation of the extenally added material.

According to an embodiment of the present invention, there is provided a charging device for electrically charging an image bearing member, comprising a contact charging member contactable to the image bearing member to charge the image bearing member, said contact charging member being supplied only with a DC voltage; and a contact member contacted to said charging member, wherein said image bearing member is adapted to carry a toner image of toner which contains an externally added material comprising silica, wherein work functions of said charging member, said contact member and the silica satisfy (the work function of said contact member)>(the work function of the silica)>(the work function of said charging member).

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described with reference to the appended drawings. Incidentally, the measurements, materials, and shapes of the structural components in the following embodiments of the present invention, and the positional relationships among them, are to be changed as necessary according to the structure of an apparatus to which the present invention is applied, and various conditions under which the present invention is applied. In other words, they are not intended to limit the scope of the present invention.

Embodiment 1

(Image Forming Apparatus)

Figure 1:
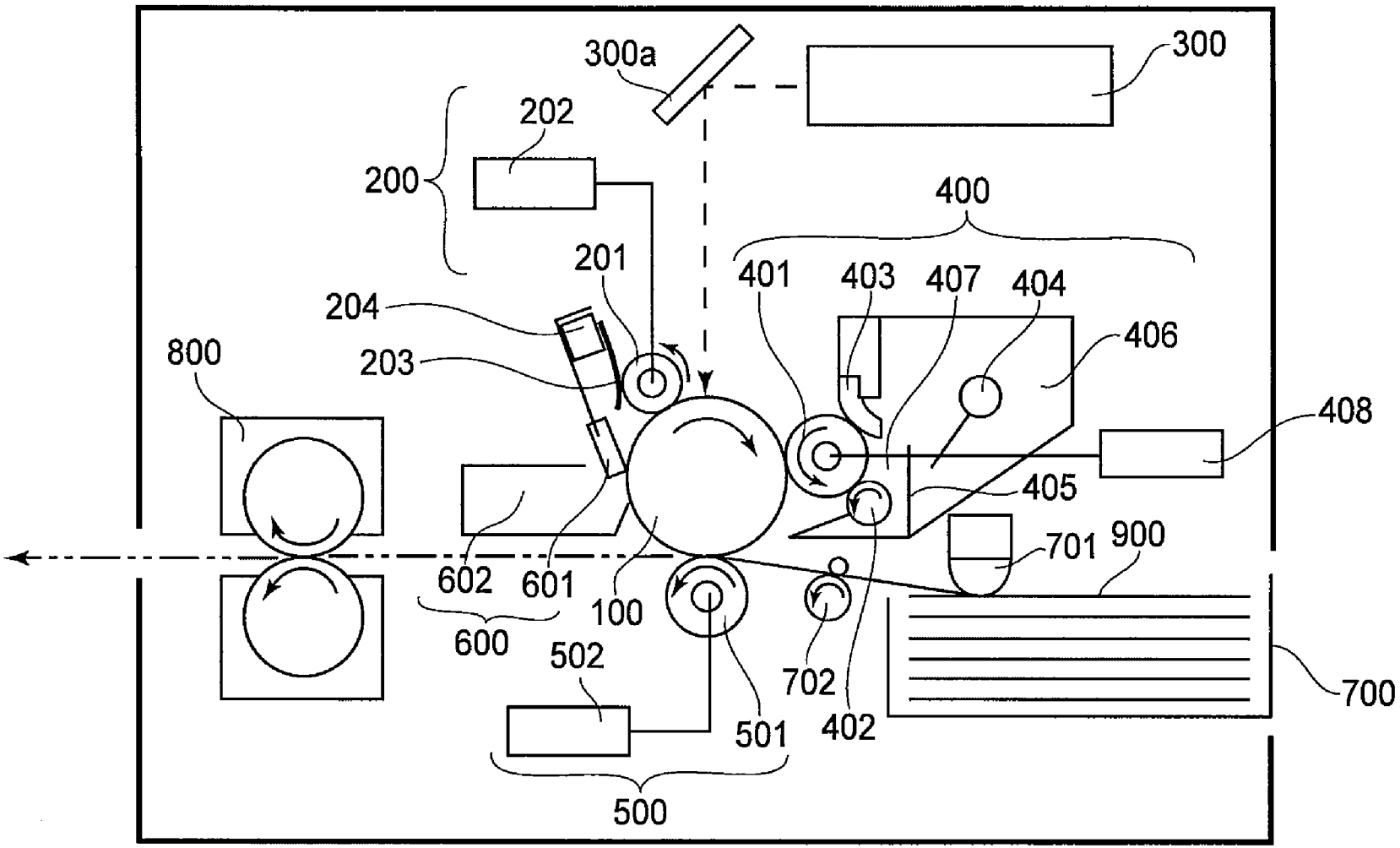
FIG. 1 is a schematic view of the image forming apparatus in the first embodiment of the present invention.

FIG. 1 is a schematic drawing of an image forming apparatus having a charging apparatus 200, which is in accordance with the present invention. This image forming apparatus is provided with a photosensitive drum 100 (electrophotographic photosensitive member in the form of drum) as an image bearing member, on which an electrostatic latent image is formed. The photosensitive drum 100 is disposed roughly in the center of the image forming apparatus. In the adjacencies of the peripheral surface of this photosensitive drum 100, a charging apparatus, an exposing apparatus, a developing apparatus, a transferring apparatus, a cleaning apparatus, etc., which are processing means, are disposed in a manner of surrounding the peripheral surface of the photosensitive drum.

The charging apparatus 200 is a charging means, which uniformly charge the photosensitive drum 100 with the use the charging method of the DC/contact type. The exposing apparatus 300 is a latent image forming means, which forms an electrostatic latent image, which reflects printing data and image formation data, on the charged photosensitive drum 100. The developing apparatus 400 is a developing means, which develops the formed electrostatic latent image into a visible image, with the use of developer. The transferring apparatus 500 is a transferring means which transfers the toner image on the photosensitive drum 100, onto a recording medium 900. The cleaning apparatus 600 is a cleaning means which removes the toner, etc., which remain on the photosensitive drum 100 after the toner image transfer. Designated by a referential symbol 700 is a cassette as a paper feeding apparatus which supplies the main assembly of the image forming apparatus with the recording medium 900. Designated by a referential symbol 800 is a fixing apparatus which permanently fixes the transferred image on the recording medium 900.

The charging apparatus 200 has a charge roller 201 as a charging member of the contact type. The charging apparatus 200 also has an electric power source for charging charge bias to the charge roller 201. Further, it has a sheet 203, which is kept in contact with the charge roller 201 to disperse the unwanted substances having adhered to the charge roller 201.

The charge roller 201 is made up of: a metallic core, which is 6 mm in diameter; a roughly 3 mm thick electrically conductive elastic layer formed of urethane rubber, around the metallic core; a several micrometer thick high resistance layer formed of urethane rubber in which carbon black has been dispersed, around the conductive elastic layer. As the material for the high resistance layer, acrylic resin, Nylon resin, fluorinated resin, or the like, may be used instead of urethane rubber. The charge roller 201 is disposed roughly in parallel to the photosensitive drum 100. It is rotatably supported at the lengthwise ends of its metallic core by electrically conductive supporting members (unshown), which are kept pressed toward the photosensitive drum 100 so that the charge roller 201 is allowed to move toward, or away from, the photosensitive drum 100. With the employment of this structural arrangement, the charge roller 201 remains under a preset amount of pressure, being thereby kept pressed on the photosensitive drum 100, against the elasticity of the conductive elastic layer of the photosensitive drum 100, forming a charging nip.

The charge roller 201 is placed in contact with the photosensitive drum 100, and is rotated by the rotation of the photosensitive drum 100. To the charge roller 201, charge bias is applied from the electric power source through the above-mentioned electrically conductive supporting members and metallic core. In this embodiment, a DC voltage of roughly −1,000 V is applied between the photosensitive drum 100 and charge roller 201, whereby the peripheral surface of the photosensitive drum 100 is charged to −500 V (dark point voltage: VD).

Figure 2:
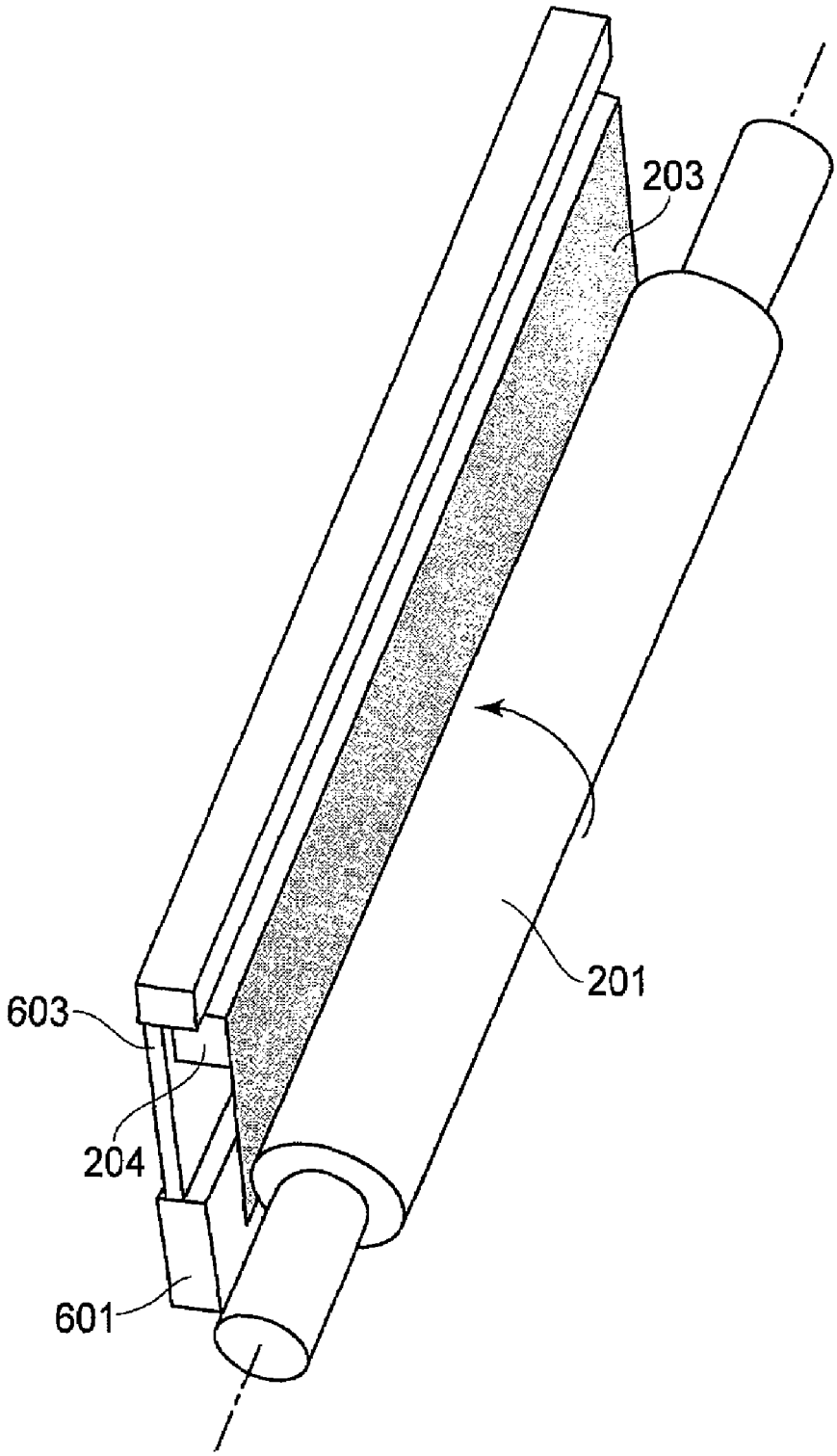
FIG. 2 is a perspective view of the charge roller, and its adjacencies, in the first embodiment of the present invention.

FIG. 2 is a top perspective view of the charge roller 201 and its adjacencies. A sheet 203 as a member to be kept in contact with the charge roller 201 is 25-100 μm in thickness. It is roughly the same in length as the elastic layer of the charge roller 201. It is supported by a sheet supporting member 204; it is pasted to the sheet supporting member 204 by one of its long edges, with the use of a piece of two-sided adhesive tape, so that it does not become wavy. The sheet supporting member 204 is rigidly fixed to a stationary cleaning blade supporting member 603 of the cleaning apparatus 600. The cleaning apparatus is designed so that the sheet 203 is kept pressed upon the peripheral surface of the charge roller 201 by a preset amount of pressure, so that the free longer edge of the sheet 203 is on the downstream side of the longer edge of the sheet 203, by which the sheet 203 is attached to the sheet supporting member 204, in terms of the rotational direction of the charge roller 201, and also, so that the contact area between the sheet 203 and charge roller 201 is substantial in width in terms of the circumferential direction of the charge roller 201. Further, the sheet 203 is placed in contact with the charge roller 201 so that there is no gap at all in the contact area between the sheet 203 and charge roller 201. With the employment of the above described structural arrangement, as the charge roller 201 is rotated, the sheet 203 rubs the charge roller 201, uniformly dispersing the unwanted substances having adhered to the charge roller 201.

In this embodiment, the following three sheets A, B, and C were prepared as the sheet 203.

Sheet A: polyimide sheet (commercial name: Upilex; product of Ube Industries Ltd.).

Sheet B: polyimide sheet (commercial name: Kapton; product of Toray •Dupon Co. Ltd.).

Sheet C: PPS (polyphenylenesulfide) sheet (commercial name: Torelina; product of Toray Industries Ltd.).

At this time, polyimide sheet will be described. Generally, polyimide is manufactured by polycondensation of aromatic tetracarboxyl acid dianhydride and aromatic diamine. Various monomers are industrially manufactured as the material for diamine, offering a large number of choices. However, the number of the choices of dianhydride of aromatic tetracarboxyl acid which are industrially manufactured is small. Thus, it is said that the properties of polyimide are dependent upon the choice of dianhydride of aromatic tetracarboxyl acid. As the material for the sheet A, that is, a polyimide sheet, biphenyl tetracarboxyl dianyhydride (BPDA) is used as the choice of the aromatic tetracarboxyl acid dianhydride. As the material for the sheet B which also is a polyimide sheet, piromerit acid dianhydride is used.

The photosensitive drum 100 is charged across its peripheral surface to −500 V (VD: dark point voltage level) by the charging apparatus 200. Thereafter, it is exposed by the exposing apparatus 300; it is exposed to a beam of laser light projected by the an exposing apparatus 300 while being modulated with printing data and image formation data. As a result, an electrostatic latent image is formed on the photosensitive drum 100. The potential level of an exposed point of the photosensitive drum 100 was −100 V (VL: light point voltage level). Designated by a referential symbol 300*a* is a deflection mirror for deflecting the beam of laser light outputted from the exposing apparatus 300, toward the points of the photosensitive drum 100, which are to be exposed.

The developing apparatus 400 is a developing apparatus of the reversal development type, which adheres negatively charged toner to the exposed points (light points) of the electrostatic latent image on the photosensitive drum 100. This developing apparatus has a hopper portion 406 and a development chamber 407, which are separated by a partitioning wall 405. In the hopper portion 406, a stirring apparatus 404 is disposed, which sends toner into the development chamber 407.

In the development chamber 407, a development roller 401 is disposed, which develops the electrostatic latent image on the photosensitive drum 100 into a toner image (image formed of toner). This development roller 401 is 16 mm in diameter. It has a substrate layer, and a surface layer coated on the substrate layer. The substrate layer is formed of silicon rubber, and the surface layer is formed of acrylic, urethane, or the like rubber. Also in the development chamber 407, a supply roller 402 is disposed, which is for supplying the development roller 401 with toner. The supply roller 402 is 16 mm in diameter, and is formed of urethane sponge. Further, a metallic development blade 403 for regulating the thickness in which toner is borne in a layer on the development roller 401 is disposed in the development chamber 407.

The developing apparatus 400 is structured so that the abovementioned stirring apparatus 404, development roller 401, and supply roller 402 can be externally driven. During a development process, the stirring apparatus 404, development roller 401, and supply roller 402 are continuously rotated to supply the photosensitive drum 100 with toner.

The development roller 401 is disposed in contact with the photosensitive drum 100 to develop the electrostatic latent image. To the development roller 401, development bias is applied from an electric power source 408. In this embodiment, the electrostatic latent image formed on the photosensitive drum 100 is developed in reverse by applying a DC voltage of roughly −300 V between the photosensitive drum 100 and development roller 401.

The transferring apparatus 500 has a transfer roller 501, which is 12 mm in diameter and is formed of EPDM sponge. This transfer roller 501 is placed in contact with the photosensitive drum 100 with the application of a preset amount of pressure, forming a transfer nip. To the transfer roller 501, a transfer bias power source 502 is connected, which is controlled so that a preset amount of voltage is applied to the transfer roller 501 during image formation.

A recording medium 900 stored in a cassette 700 as a paper feeding apparatus is delivered by a paper feeding roller 701 to a registration roller 702, in synchronism with the progression of the formation of a toner image on the photosensitive drum 100. Then, the recording medium 900 is delivered by the registration roller 702 to the transfer nip, that is, the contact area between the transfer roller 501 and photosensitive drum 100, in synchronism with the arrival of the leading edge of the toner image being formed on the photosensitive drum 100, at the transfer nip. After arriving at the transfer nip, the recording medium 900 is conveyed through the transfer nip while remaining pinched by the transfer nip. While the recording medium 900 is conveyed through the transfer nip, a DC voltage of roughly −1,000 V, as a transfer bias, is applied to the transfer roller 501 from the power source 502. As a result, the toner image on the photosensitive drum 100 is electrostatically transferred onto the recording medium 900 as if it were rolled out of the photosensitive drum 100.

After coming out of the transfer nip, the recording medium 900 is separated from the peripheral surface of the photosensitive drum 100, and then, is conveyed to the fixing apparatus 800, by which the unfixed toner image on the recording medium 900 is fixed, that is, turned into a permanent image, by heat and pressure. After coming out of the fixing apparatus 800, the recording medium 900 is discharged as a copy from the image forming apparatus.

Meanwhile, the transfer residual toner, that is, the toner remaining on the photosensitive drum 100 after the recording medium 900 having come out of the transfer nip is separated from the photosensitive drum 100, is removed from the peripheral surface of the photosensitive drum 100; it is wiped away by the cleaning blade 601 of the cleaning apparatus 600, which is formed of urethane rubber. The removed transfer residual toner is stored in a waste toner container 602. Thereafter, the cleaned portion of the peripheral surface of the photosensitive drum is charged again by the charging apparatus 200, for the following image formation cycle.

The toner used in this embodiment is a nonmagnetic single-component developer. As the bonding resin for the toner, one of such resins as copolymer of styrene and acrylic, copolymer of styrene and methacrylic, polyester, and the like is used. As the controlling agent for charging toner to the negative polarity, organic metallic complexes, and chelate compounds are effective. More specifically, mono-azoic metallic compounds, acetyl-acetonic metallic compounds, aromatic hydroxy carboxyl acids, aromatic dicarboxylic metallic compounds, are usable to ensure that toner is charged to the negative polarity.

The amount (ratio) of a coloring agent for toner is 0.1-60, preferably, 0.5-50, units of mass per 100 units of mass of bonding resin. The amount (ratio) of polarity controlling agent is 0.1-15, preferably, 0.5-10, units of mass per 100 units of mass of the bonding resin.

Further, for the purpose of giving toner properties that are desirable for powder, microscopic powder of an inorganic substance, such as silica, alumna, titanium oxide, hydrotalcite compound, di-tertiary butyl salicylic aluminum complex, or the like are added, as external additives, to toner, alone or in combination.

These inorganic powders are desired to be 20 $m^2$/g-400 $m^2$ in specific surface. Further, these inorganic powders may be surface-treated. As the surface treatment agent for these inorganic powders, silane coupling agent, titanium coupling agent, silicone oil, and the like can be listed. Preferably, these inorganic powders are treated with silane coupling agent or silicone oil coupling agent; they may be surface-treated with the combination of silane coupling agent and silicone oil coupling agent. The amount (ratio) by which the abovementioned microscopic powders are to be added to toner is 0.03-5, preferably, 0.03-3, units of mass per 100 units of mass of toner.

In this embodiment, a product yielded by adding 1.5 parts of silica (external additive α), 0.1 part of hydrotalcite compound, 0.1 part of di-tertiary butyl salicylic acid aluminum complex, to 100 parts of toner, in terms of mass, was used as the developer.

When these additive were used as the external additives, defective images were formed, the defects of which were attributable to the adhesion of silica to the abovementioned sheet of the charging apparatus 200. Therefore, silica was evaluated as the external additive α.

(Measurement of Work Function)

The nonuniform charging of the photosensitive drum 100, which is traceable to the nonuniform toner adhesion to the charge roller 201, can be prevented by the dispersion of the toner having adhered to the charge roller 201, by the sheet 203 placed in contact with the charge roller 201.

However, as described above, toner contains the external additives, which are extremely small in particle diameter (roughly 0.01 μm in volume average diameter) compared to the particle diameter (roughly 6 μm in volume average particle diameter) of toner. These external additives adhere to the abovementioned sheet 203 of the charging apparatus 200, and accumulate thereon. Thus, even if the transfer residual toner is uniformly dispersed by the sheet 203, the unsatisfactory charging of the photosensitive drum 100, which is traceable to the adhesion of the external additives to the sheet 203 and the resultant accumulation of the external additives on the sheet 203, still occurs.

In this embodiment, therefore, the charging apparatus 200 was designed so that the relationship in terms of work function among the charge roller 201 as the charging member, the sheet 203 as the residual toner dispersing member, and silica satisfies an inequality: sheet 203>silica>charge roller 201. With the employment of this design, the unsatisfactory charging of the photosensitive drum 100, which is traceable to the adhesion of the external additive (silica) of the toner to the sheet 203, and the resultant accumulation of the external additive (silica) on the sheet 203, is prevented.

Next, this embodiment will be evaluated regarding the relationships among the charge roller 201, sheet 203 placed in contact with the charge roller 201, and external additive α, in terms of the work function which is measured using the following measuring method.

Work function (ϕ) is known as the energy necessary to free an electron from a substance. The smaller the work function of a substance, the easier it is to free an electron from the substance; the greater the work function of a substance, the more difficult to free an electron from the substance. Therefore, a substance which is smaller in work function is characterized in that it is likely to be positively charged, whereas a substance which is larger in work function is characterized in that it is likely to be negatively charged.

The value of the work function of a given substance is measured using the following measuring method, and is expressed, in numerical value, as the amount of energy (eV) necessary to free an electron from the substance. It can be used for evaluating various substances as the materials for the components of the image forming apparatus, the external additives, etc., in terms of the inherent polarity to which they become charged.

The work function a substance is measured using a surface analyzing apparatus AC-2 (product of Riken Instrument Co., Ltd.) which employs the low energy electronic measurement method). In this embodiment of the present invention, a heavy hydrogen lamp is used with the surface analyzing apparatus, and its luminous energy is set to 500 nW. A light separating apparatus is used to choose one of the monochromatic lights, and a beam of the selected monochromatic light is projected on a text sample so that the spot size becomes 4 mm square, and an energy scan range falls in the range of 3.4-6.2 eV. The length of measurement is 10 seconds per spot. While the test sample is illuminated, the photoelectrons freed from the surface of the test sample are detected, and the result of the detection was process with the use of a work function computation software. The work function was measured at a repeatability level (standard deviation) of 0.02 eV. Incidentally, as for the measurement conditions for ensuring the data reproducibility, test samples were left unattended for 24 hours at 25° C. and 55% RH.

Figure 3:
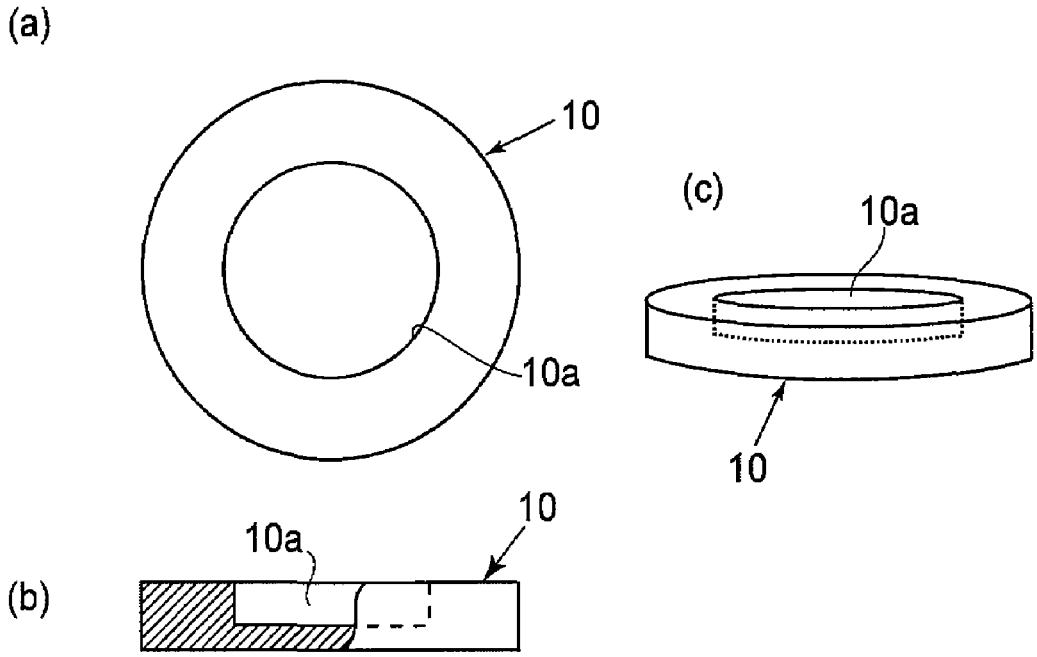
FIG. 3 illustrates a cell dedicated to measuring the work function of external additive, wherein (a) is a schematic plan view of the cell dedicated to measuring the work function of external additive; (b) is a schematic side view of the cell dedicated to measuring the work function of the external additive; and (c) is a perspective view of the cell dedicated to measuring the work function of the external additive.

In order to measure the work functions of test samples of external additives, a cell such as a cell 10, shown in FIG. 3, which is dedicated to work function measurement, is used. FIG. 3(*a*) is a plan view of the cell 10, and FIG. 3(*b*) is a partially cutaway side view of the cell 10. FIG. 3(*c*) is a perspective view of the cell 10. This cell 10 is 30 mm in diameter and 5 mm in height. It is formed of stainless steel, and has a recess 10*a* for holding an external additive. The recess 10*a* is 15 mm in diameter and 3 mm in depth. Silica is placed in the recess 10*a*, using a measurement spoon, without packing the silica. Then, the body of the silica in the recess 10*a* is flattened using a knife edge so that the top surface of the body of the silica become level with the top edge of the recess 10*a*. Then, the cell 10 is unmovably attached to a preset position of the sample table, to measure the test sample.

Figure 4:
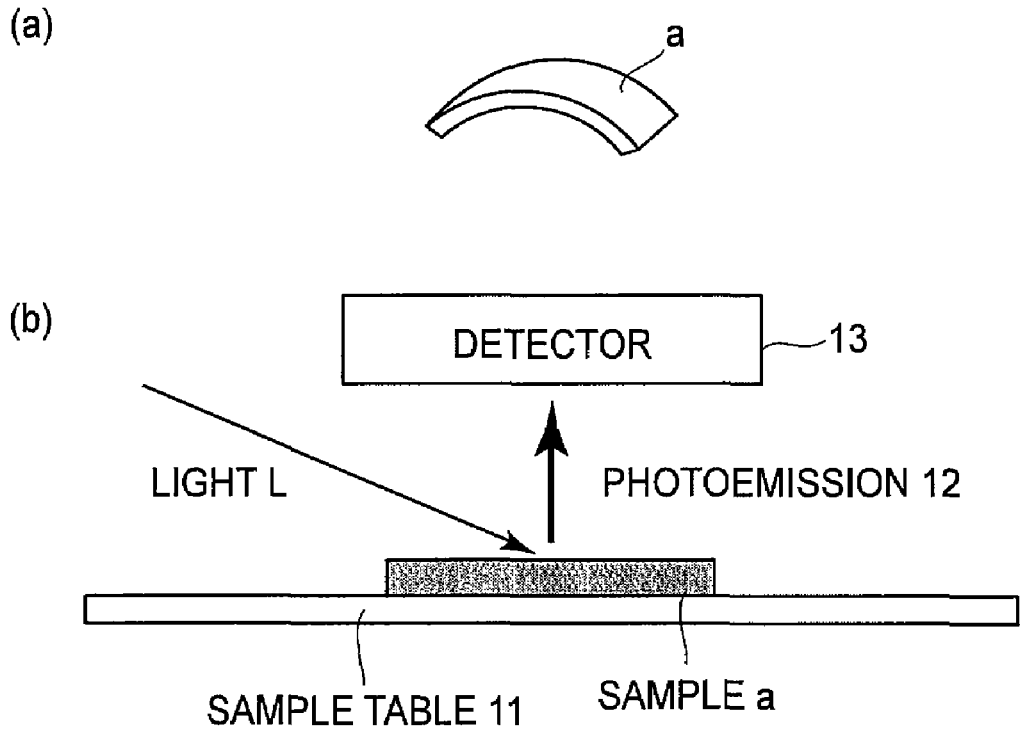
FIG. 4*a* is a schematic view of a test sample cut from the cylindrical image forming apparatus member to measure the work function of the member.
FIG. 4*b* is a schematic drawing of a surface analyzing apparatus.

In order to measure the work function of a cylindrical member of an image forming apparatus, for example, a charge roller, the cylindrical member of an image forming apparatus is to be cut crosswise to obtain a 1-1.5 cm wide piece of the cylindrical member. Then, the piece is to be cut in parallel to the axial line of the cylindrical member to obtain a test piece a having the shape shown in FIG. 4(*a*). Then, the test piece a is to be immovably attached to the preset location of the sample table 11 so that its surface to be irradiated with the beam of measurement light L, that is, the surface facing the direction from which the beam of measurement light L is projected, is flat and smooth as shown in FIG. 4(*b*). With the employment of this arrangement, it is ensured that the freed photoelectron 12 is detected by a detecting device 13 (photomultiplier tube).

When a flat member of an image forming apparatus, such as the sheet 203 placed in contact with the charge roller 201, is sampled, a test piece which is no smaller than 1 cm square is to be cut from the flat member, and this piece is immovably attached to the sample table 11, for measurement. This is because the measurement light is controlled so that the spot it forms on the test piece is 4 mm square, as described above.

In this surface analysis test, the beam of monochromatic light is gradually increased in excitation energy from the preset value. As it is increased, a photoelectron begins to be freed when the excitation energy reaches a certain value [eV] . This value, that is, the threshold value, is the work function [eV] of the test sample.

Figure 5:
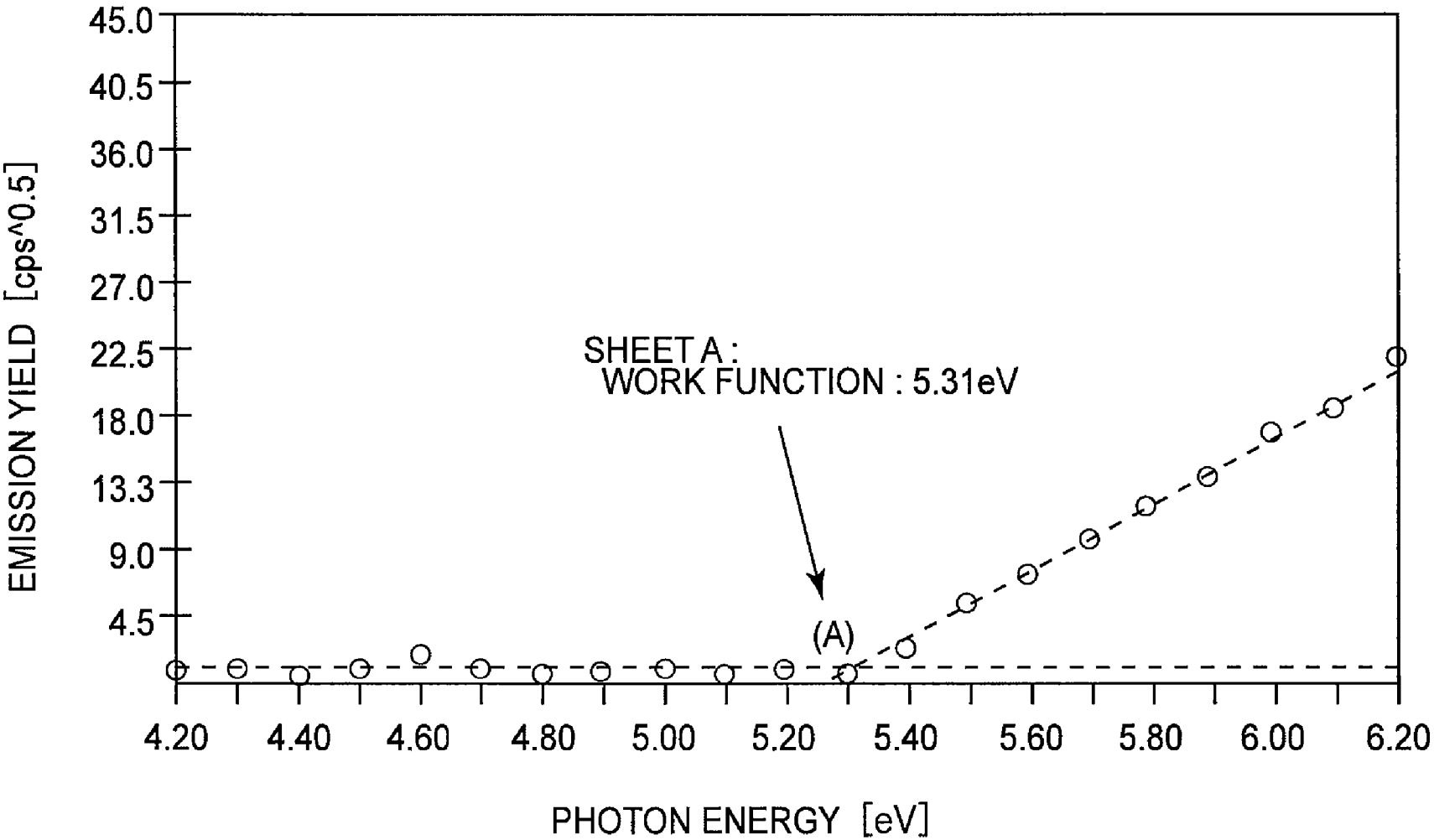
FIG. 5 is a graph of the work function of the sheet A, which was measured using the surface analyzing apparatus.

FIG. 5 is a graph showing the results of the analysis of the abovementioned sheet A formed of polyimide sheet (commercial name: Upilex; product of Ube Industries Ltd.), which were obtained with the use of a surface analyzing apparatus. In FIG. 5, the excitation energy [eV] is represented by the horizontal axis, and the normalized yield of photon (n-th power of photon yield per unit amount of photon) is represented by the vertical axis. Where the excitation energy is greater than the value at which a photoelectron begins to be freed, the relationship between the excitation energy and the amount of the freed photoelectrons is linear; the value of Y/eV is constant. In FIG. 5, the work function of the sheet A is represented by the value of excitation energy [eV] at the point (A) at which the graph bends. In other words, in FIG. 5, the work function of the sheet A is 5.31 [eV].

Figure 6:
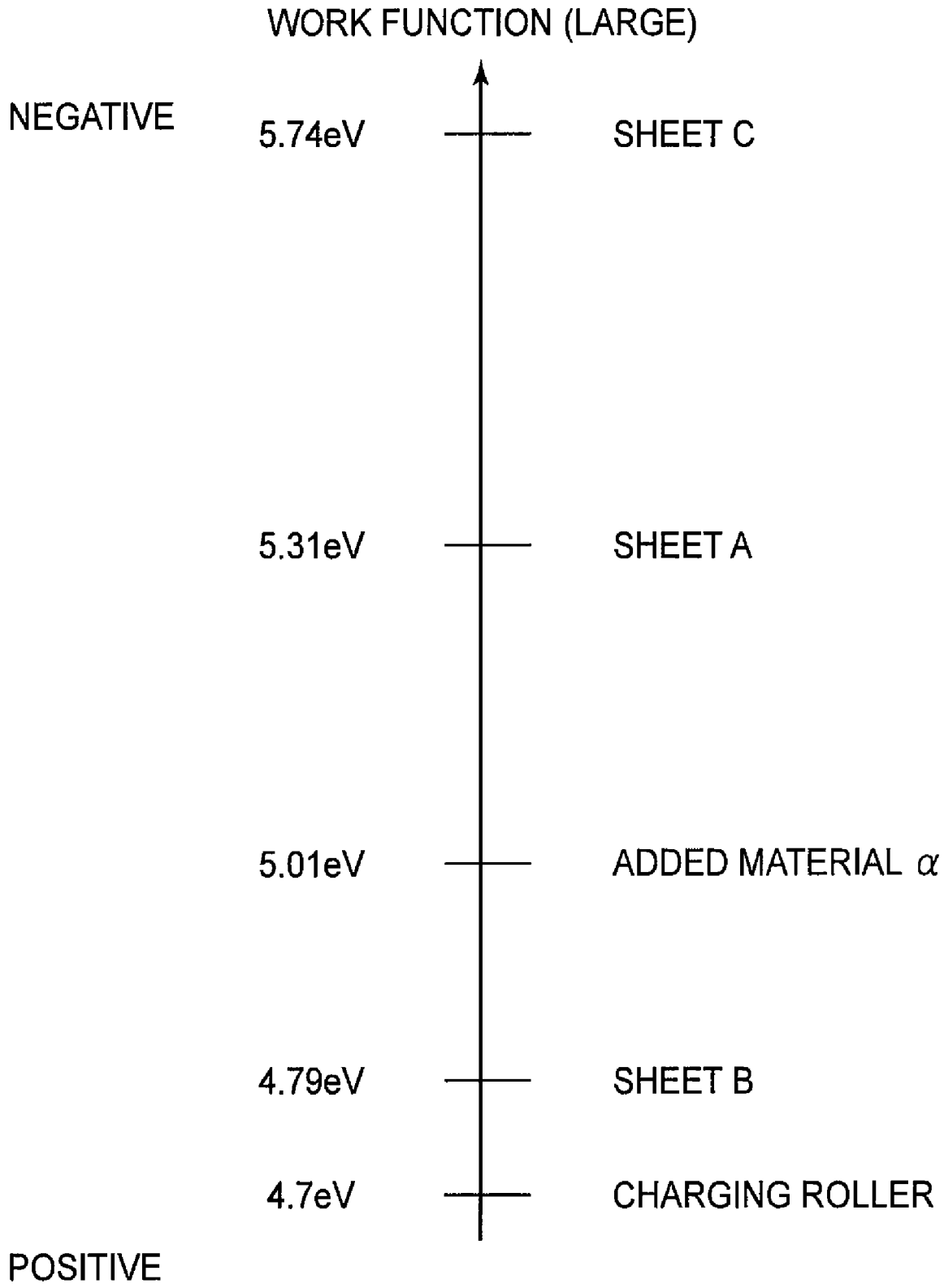
FIG. 6 is a diagram showing the order in terms of work function among the rubbing sheets, external additive, and charge roller.

FIG. 6 is a diagram showing the relationships among the work function values of the charge roller 201, three sheets A, B, and C, placed in contact with the charge roller 201, and the external additive α (silica), which were measured with the use of the above described method.

Among those components and the external additive, the charge roller 201 is most likely to become positively charged, and the sheet C is most likely to become negatively charged.

In this embodiment 1, the combination of the charge roller 201, sheet B, and external additive α, the work functions of which were measured with the use of the above described method, and the combination of the charge roller 201, sheet C, and external additive α, the work functions of which were also measured with the use of the above described method, were employed. For comparison, the combination of the charge roller 201, sheet B, and external additive α was employed. Each of these combinations was used to assembly a charging apparatus. Then, each of the assembled charging apparatuses was employed by the above described image forming apparatus to actually form images. The evaluations of the yielded images are given in Table 1.

TABLE 1

| | Occurrences of stripes |
|---|---|
| sheet A (Emb.) | Non |
| sheet B (Comp. Ex.) | Yes |
| sheet C (Emb.) | Non |

The reason why the tests yielded the above results can be thought to be as follows. In the case of the charging apparatus 200 in this embodiment, the relationships among the work functions of the charge roller 201, sheet 203, and silica satisfied the inequality: sheet>silica>charge roller. It can be said that when this inequality was satisfied, the sheet 203 was more likely to become negatively charged than silica, and the charge roller 201 was more likely to become positively charged than silica. Thus, as silica was given negative electrical charge through the charging process, it was repelled by the sheet 203. As a result, silica did not adhere to the sheet 203, being instead adhered to the charge roller 201 which had become positively charged. As silica was adhered to the charge roller 201, it moved with the peripheral surface of the charge roller 201, being thereby uniformly dispersed by the sheet 203 instead of accumulating on the sheet 203. Therefore, the charge roller 201 is prevented from unsatisfactorily charging the photosensitive drum 100 in a pattern of circumferential stripes. As the charge roller 201 is further rotated, the silica on the charge roller 201 is again given negative electric charge through the charging process. Then, it is electrostatically moved onto the photosensitive drum 100 by the electric field formed between the charge roller 201 and photosensitive drum 100. Incidentally, during this process, some of the silica particles are given an unsatisfactory amount of electric charge. However, as they are repeatedly subjected to the charging process, they are eventually given a satisfactory amount of negative electric charge, being thereby moved onto the photosensitive drum 100. This is thought to be why the formation of an image suffering from the image defects attributable to silica was prevented in this embodiment.

Next, referring to FIG. 6, the test in which the sheet A was used, and the test in which the sheet B was used, will be described.

(Test in which Sheet A was Used)

In the test in which sheet A was used, the work function of the sheet A was 5.31 [eV], and the work function of the charge roller 201 was 4.7 [eV], as shown in FIG. 6. Thus, as the sheet A and charge roller 201 rubbed against each other in the contact area between the sheet A and charge roller 201, the sheet A became negatively charged, whereas the charge roller 201 became positively charged. Since the silica having become negatively charged is 5.01 [eV] in work function, it was repelled by the sheet A having become negatively charged to a potential level, the absolute value of which was greater than that of the potential level to which the silica had become negatively charged. As a result, the silica did not adhere to the sheet A, being instead attracted by the charge roller 201 having become positively charged. Thus, the silica adheres to the charge roller 201. Then, it moved with the peripheral surface of the charge roller 201 as the charge roller 201 was rotated.

Regarding the electrostatic force generated in the contact area between the sheet A and charge roller 201, generally, the magnitude of electrostatic force generated between two objects is determined by the difference in work function between the two objects. The greater the difference, the greater the electrostatic force, and the smaller the difference, the smaller the electrostatic force. When the sheet A is employed as the sheet 203, the electrostatic force generated in the contact area between the charge roller 201 and sheet 203 is greater than when the sheet B, which will be described later, is used as the sheet 203, because of the relationship between the sheets A and B in terms of which is greater in work function. In addition, the absolute value of the potential level to which the sheet A is negatively charged is greater than that of the potential level to which silica is negatively charge. Therefore, such force that causes the silica and sheet A to repel each other is generated. Thus, it does not occur that the silica adheres to the sheet 203 (A), in the contact area between the sheet 203 (A) and charge roller 201. Consequently, the silica is evenly distributed on the charge roller 201, being thereby prevented from causing the photosensitive drum 100 to be unsatisfactorily charged in the pattern of circumferential stripes. After being evenly distributed on the charge roller 201, the silica is again given negative electrical charge, moving therefore onto the photosensitive drum 100, because such an electric field that causes the negatively charged particles to move onto the photosensitive drum 100 is present between the photosensitive drum 100 and charge roller 201. After moving onto the photosensitive drum 100, the silica is eventually recovered by the developing apparatus 400, transferring apparatus 500, and cleaning apparatus 600. Incidentally, in the above, the electrostatic force between the sheet A and charge roller 201 was described. However, the formation of a defective image, the flaws of which are attributable to the silica adhesion, can be prevented, for the same reason as given above, by using sheet C which is far greater in work function than the sheet A. In other words, all that is necessary to prevent the formation of the above described defective image is to select, as the material for the sheet 203, which is placed in contact with the charge roller 201, such a substance that satisfies the following relationships in terms of the work function value: particle dispersing member>silica>charging member. Incidentally, the usage of the sheet C as the sheet 203 renders greater the difference in work function between the sheet 203 and charge roller 201 than the usage of the sheet A as the sheet 203, generating thereby a greater amount of electrostatic force between the sheet 203 and charge roller 201. In other words, the usage of the sheet C increases the amount of force which causes the sheet 203 and silica to repel each other. This is thought to be why the force which works to prevent silica from adhering to the sheet 203 is greater when the sheet C is used than when the sheet B is used.

(Test in which Sheet B was Used)

In comparison, in the test in which sheet B was used as the sheet 203, the work function of the sheet 203 (B) was 4.79 [eV], and the work function of the charge roller 201 was 4.7 [eV], as shown in FIG. 6. Thus, as the sheet B and charge roller 201 rubbed against each other in the contact area between the sheet B and charge roller 201, the sheet B became negatively charged relative to the charge roller 201, whereas the charge roller 201 became positively charged relative to the sheet B. However, the external additive α (silica) having become negatively charged was 5.01 [eV] in work function. Further, relative to the electrical charge of silica, the electrical charge of the sheet B and the electrical charge of the charge roller 201 are both on the positive side. Therefore, it is possible that there was a case in which the silica moved with the peripheral surface of the charge roller 201 as the charge roller 201 was rotated, and a case in which the silica adhered to the sheet B. In addition, the electrostatic force in the contact area between the sheet B and charge roller 201 was smaller than that generated when the sheet A was used as the sheet 203. Thus, when the sheet B was used as the sheet 203, it was difficult to evenly disperse the silica having adhered to the charge roller 201. Therefore, the silica adhered to the sheet B, and accumulated thereon, forming minuscule projections, which scratched the charge roller 201. This seems to be why the photosensitive drum 100 was unsatisfactorily charged in the pattern of circumferential streaks.

Therefore, it is desired that the sheet A or sheet C, which are greater in work function than the external additive α (silica) is used as the sheet 203, as is in this embodiment (Embodiment 1).

The charging apparatus 200, in which the sheet A was used as the sheet 203, was fitted in an image forming apparatus. Then, 10,000 copies were actually formed using the image forming apparatus. The images were satisfactory, proving that silica was dispersed on the charge roller 201, instead of adhering to the sheet A, being prevented from causing the photosensitive drum 100 to be unsatisfactorily charged in the pattern of circumferential streaks.

Embodiment 2

Figure 7:
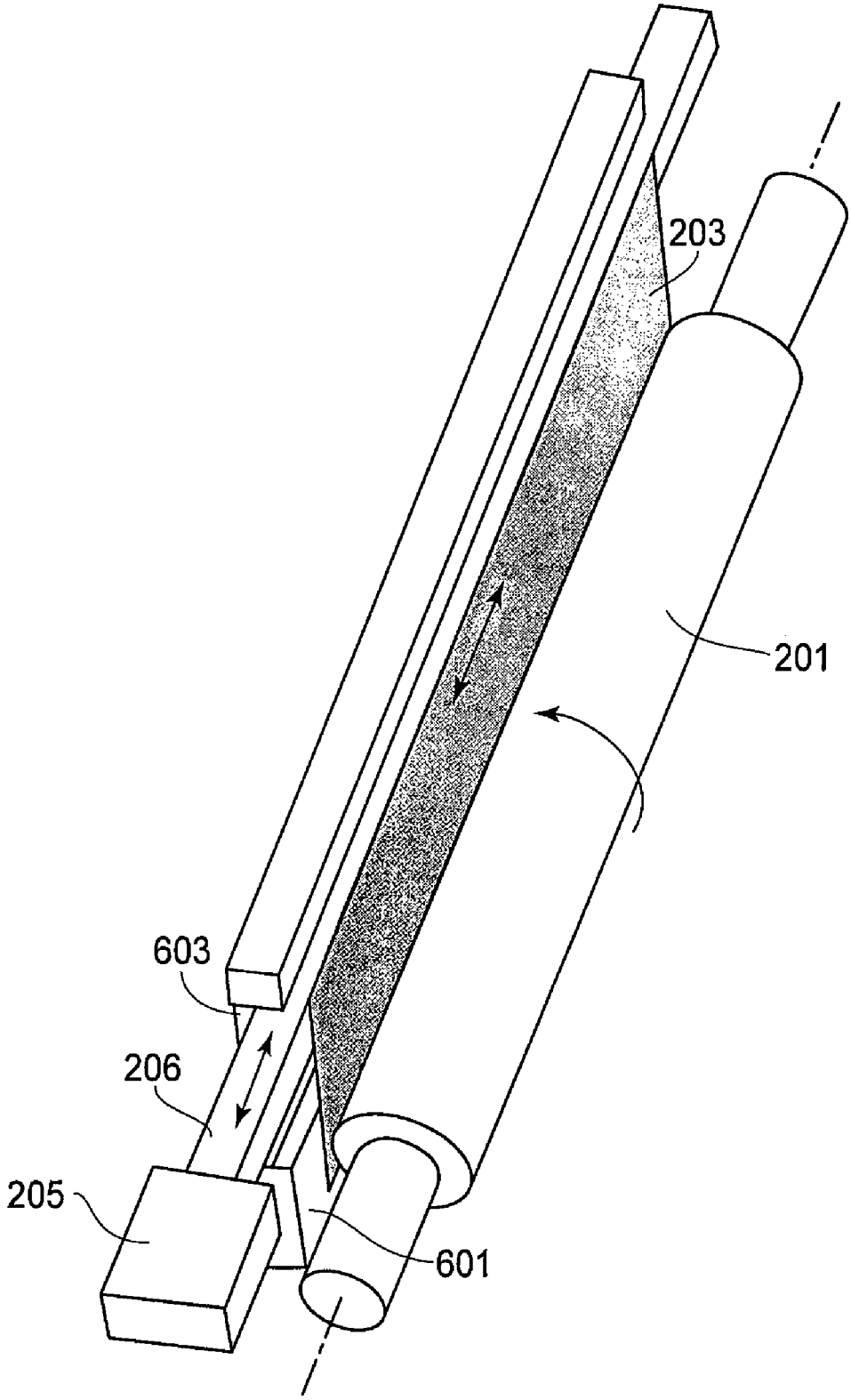
FIG. 7 is a schematic drawing of the rubbing sheet, in the second embodiment, which is equipped with a driving mechanism.

In the second embodiment, a structural arrangement is made so that the sheet 203 can be reciprocally moved, while being kept in contact with the charge roller 201, roughly in parallel to the lengthwise direction (axial line) of the photosensitive drum 100. More specifically, referring to FIG. 7, designated by a referential symbol 206 is a reciprocally movable member for supporting the sheet 203. The reciprocally movable sheet supporting member 206 is supported roughly in parallel to the charge roller 201 by a guiding member (unshown) so that it can be slid in the lengthwise direction of the charge roller 201. The sheet 203, which is placed in contact with the charge roller 201, is supported by the reciprocally movable sheet supporting member 206; one of the long edges of the sheet 203 is pasted to the abovementioned reciprocally movably sheet supporting 206, with the use of a piece of two-sided adhesive tape, so that the sheet 203 does not become wavy. The sheet 203 is tilted so that its long edge by which the sheet 203 is not pasted to the supporting member 206 is on the downstream side of its long edge by which the sheet 203 is pasted to the supporting member 206, in terms of the rotational direction of the charge roller 201. Further, the sheet 203 is kept in contact with the charge roller 201 with the application of a proper amount of pressure for causing the sheet 203 to contact the charge roller 201 by the middle portion instead of the edge, and also, so that no gap is created in the contact area between the charge roller 201 and sheet 203. The reciprocally movable supporting member 206 is reciprocally moved by a reciprocal driving mechanism 205 such as a cranking mechanism.

With the provision of this structural arrangement, not only is it possible to obtain the effect of preventing the adhesion of the external additive to the sheet 203, by utilizing the relationships in terms of work function among the charge roller 201, sheet 203, and external additive, but also, it is possible to obtain the effect of more efficiently dispersing the external additive by the sheet 203. Therefore, it possible to prevent the photosensitive drum 100 from being unsatisfactorily charged in the pattern of circumferential streaks; it is possible to uniformly charge the photosensitive drum 100.

Embodiment 3

The third embodiment is one of the cases in which the charging apparatus 200 is incorporated into a process cartridge removably mountable in the main assembly of an image forming apparatus.

Figure 8:
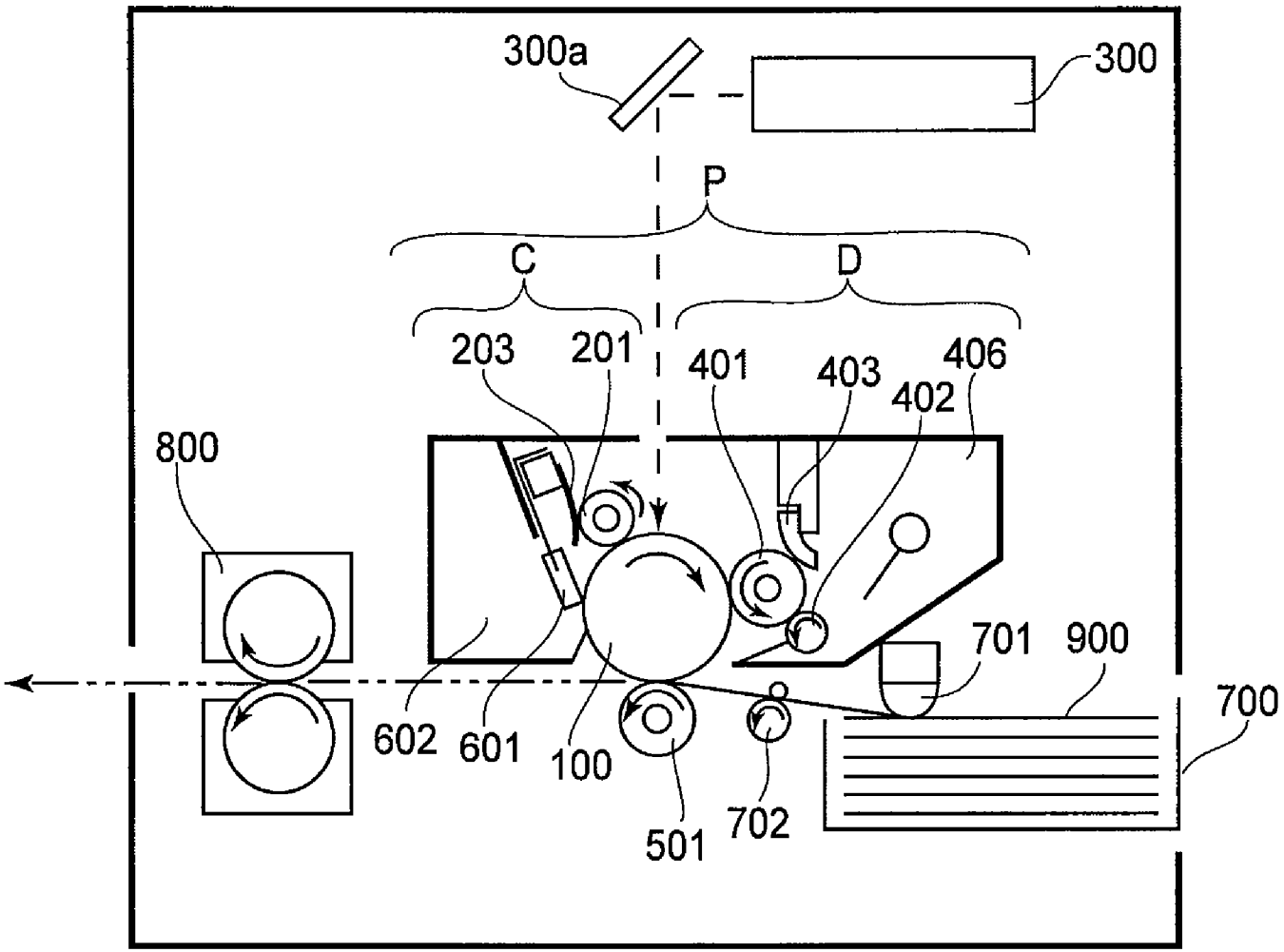
FIG. 8 is a schematic drawing of an image forming apparatus in which a process cartridge is removably mountable.

FIG. 8 is a schematic drawing of the image forming apparatus structured so that a process cartridge P in accordance with the present invention is removably mountable.

The process cartridge P in this embodiment is made up of a development process unit D and an image formation process unit C, which are integrally joined.

The development process unit D is equipped with a hopper 406 in which toner is held, a development roller 401 as a developer bearing member, a supply roller 402 for supplying the development roller 401 with toner, and a development blade 403 as a developer regulating means.

The image formation process unit C is equipped with a photosensitive drum 100 as a latent image bearing member, and a charge roller 201 for uniformly charging the peripheral surface of the photosensitive drum 100. The image formation process unit C is also provided with a sheet 203 placed in contact with the charge roller 201, and a cleaning blade 601 for removing the unwanted substances, such as the transfer residual toner, on the photosensitive drum 100.

The process cartridge P is provided with a mounting means (unshown) for removably mounting the process cartridge P into the image forming apparatus main assembly, and is removably mountable in the image forming apparatus main assembly.

The process cartridge P in this embodiment employs the sheet A and charge roller 201, which are used in the first embodiment, and which satisfy the following inequity regarding the relationship among the work functions of sheet, silica, and charging member: sheet>silica>charging member.

As a print start signal is inputted into an image forming apparatus main assembly which contains the above described process cartridge P, driving force is transmitted from the image forming apparatus main assembly to the photosensitive drum 100, development roller 401, and supply roller 402. Further, biases are applied from the main assembly to the charge roller 201 and development roller 401. The photosensitive drum 100 is exposed for image formation, by the exposing apparatus 300. As a result, an electrostatic latent image is formed on the photosensitive drum 100. The latent image is developed by the development roller 401 into a toner image, and the toner image is transferred by a transfer roller 501 onto a recording medium 900. The recording medium 900 is conveyed to a fixing apparatus 800, in which the toner image is fixed by heat and pressure. Meanwhile, the unwanted substances, such as the toner, paper dust, external additive, etc., remaining on the photosensitive drum 100 after the transfer are removed by the cleaning blade 601, and are accumulated in a waste toner container 602. Thereafter, the peripheral surface of the photosensitive drum 100 is charged again by the charge roller 201 to be put through the above described steps.

Because the relationships in terms of work function among the sheet A, silica, and charge roller 201 are: sheet A>silica>charge roller 201, the silica particles having slipped by the cleaning blade 601 adhere to the charge roller 201, but, they do not adhere to the sheet A. Thus, they are evenly dispersed on the charge roller 201.

The process cartridge P in this embodiment was attached to the image forming apparatus main assembly, and this image forming apparatus was used to form 10,000 images. As a result, excellent images were obtained, proving that the unsatisfactory charging of the photosensitive drum 100, which is in the form of circumferential streaks and attributable to silica, did not occur.

The materials for the sheet 203 do not need to be limited to the substances listed in the first embodiment. For example, in a case in which silica is used as the external additive, a sheet formed of a substance which is far greater in work function than the materials for the sheets A and C may be employed as the sheet 203. In other words, all that is necessary is that the materials for the charge roller 201, and the sheet 203 which is placed in contact with the charge roller 201, are correctly selected so that the particle dispersing sheet (sheet 203), silica, and charge roller satisfy the following inequality in terms of work function: particle dispersing member>silica>charge roller. With this assurance, it is possible to prevent the external additive from adhering to the particle dispersing member, and therefore, it is possible to prevent the photosensitive drum from being nonuniformly charged in the pattern which results in the formation of an image suffering from unwanted vertical streaks; it is possible to uniformly charge the photosensitive drum.

While the invention has been described with reference to the structures disclosed herein, it is not confined to the details set forth, and this application is intended to cover such modifications or changes as may come within the purposes of the improvements or the scope of the following claims.

This application claims Priority of Japanse Patent Applications Nos. 045457/2005 and 039570/2006 filed Feb. 22, 2005 and Feb. 16, 2006, which are hereby incorporated by reference.

What is claimed is:

1. A charging device for electrically charging an image bearing member, comprising:

a contact charging member contactable to the image bearing member to charge the image bearing member, said contact charging member being supplied only with a DC voltage; and a contact member contacted to said contact charging member, wherein the image bearing member is adapted to carry a toner image of toner which contains an externally added material comprising silica, wherein the silica on said contact charging member is charged to a negative polarity, and wherein said contact member has a work function larger than a work function of the silica, and said contact charging member has a work function smaller than the work function of the silica, wherein the work function of said contact member is the amount of excitation energy that must be applied thereto to free an electron therefrom, wherein the work function of said contact charging member is the amount of excitation energy that must be applied thereto to free an electron therefrom, wherein the work function of said silica is the amount of excitation energy that must be applied thereto to free an electron therefrom, wherein the amount of excitation energy necessary to free an electron from said contact member is larger than the amount of excitation energy necessary to free an electron from said silica, and wherein the amount of excitation energy necessary to free an electron from said contact charging member is smaller than the amount of excitation energy necessary to free an electron from the silica.

2. An apparatus according to claim 1, wherein the silica has a particle size smaller than that of the toner.

3. An apparatus according to claim 1, wherein said contact member is reciprocable in an axial direction of said contact charging member.

4. A process cartridge detachably mountable to a main assembly of an image forming apparatus, said process cartridge comprising:

an image bearing member;

a contact charging member contactable to said image bearing member to charge said image bearing member, said contact charging member being supplied only with a DC voltage;

a developing device that develops a toner image on said image bearing member with toner comprising an externally added material, wherein the externally added material comprises silica, wherein the silica on said contact charging member is charged to a negative polarity; and a contact member contacted to said contact charging member, and wherein said contact member has a work function larger than a work function of the silica, and said contact charging member has a work function smaller than the work function of the silica, wherein the work function of said contact member is the amount of excitation energy that must be applied thereto to free an electron therefrom, wherein the work function of said contact charging member is the amount of excitation energy that must be applied thereto to free an electron therefrom, wherein the work function of the silica is the amount of excitation energy that must be applied thereto to free an electron therefrom, wherein the amount of excitation energy necessary to free an electron from said contact member is larger than the amount of excitation energy necessary to free an electron from the silica, and wherein the amount of excitation energy necessary to free an electron from said contact charging member is smaller than the amount of excitation energy necessary to free an electron from the silica.

5. An image forming apparatus comprising:

an image bearing member;

a charging device that electrically charges said image bearing member;

a latent image forming device that forms an electrostatic latent image on said electrically charged image bearing member;

a developing device that develops a toner image on said image bearing member with toner comprising an externally added material, wherein the externally added material comprises silica;

a transferring device that transfers a toner image formed on said image bearing member onto a recording material;

a cleaning device that removes the toner remaining on said image bearing member after transfer of the image, wherein said charging device includes a contact charging member contactable to said image bearing member to charge said image bearing member, said contact charging member being supplied only with a DC voltage, and a contact member contacted to said contact charging member, wherein the silica on said contact charging member is charged to a negative polarity, and wherein said contact member has a work function larger than a work function of the silica, and said contact charging member has a work function smaller than the work function of the silica, wherein the work function of said contact member is the amount of excitation energy that must be applied thereto to free an electron therefrom, wherein the work function of said contact charging member is the amount of excitation energy that must be applied thereto to free an electron therefrom, wherein the work function of the silica is the amount of excitation energy that must be applied thereto to free an electron therefrom, wherein the amount of excitation energy necessary to free an electron from said contact member is larger than the amount of excitation energy necessary to free an electron from the silica, and wherein the amount of excitation energy necessary to free an electron from said contact charging member is smaller than the amount of excitation energy necessary to free an electron from the silica.

6. A charging device for electrically charging an image bearing member, comprising:

a contact charging member contactable to the image bearing member to charge the image bearing member, said contact charging member being supplied only with a DC voltage; and a contact member contacted to said contact charging member, wherein the image bearing member is adapted to carry a toner image of toner which contains an externally added material comprising silica, wherein said contact member comprises one of polyimide containing biphenyl tetracarboxyl dianyhydride and polyphenylenesulfide, wherein the silica on said contact charging member is charged to a negative polarity, and wherein said contact member has a work function larger than a work function of the silica, and said contact charging member has a work function smaller than the work function of the silica, wherein the work function of said contact member is the amount of excitation energy that must be applied thereto to free an electron therefrom, wherein the work function of said contact charging member is the amount of excitation energy that must be applied thereto to free an electron therefrom, wherein the work function of the silica is the amount of excitation energy that must be applied thereto to free an electron therefrom, wherein the amount of excitation energy necessary to free an electron from said contact member is larger than the amount of excitation energy necessary to free an electron from the silica, and wherein the amount of excitation energy necessary to free an electron from said contact charging member is smaller than the amount of excitation energy necessary to free an electron from the silica.

7. An apparatus according to claim 6, wherein the silica has a particle size smaller than that of the toner.

8. An apparatus according to claim 6, wherein said contact member is reciprocable in an axial direction of said contact charging member.

9. A process cartridge detachably mountable to a main assembly of an image forming apparatus, said process cartridge comprising:

an image bearing member;

a contact charging member contactable to said image bearing member to charge said image bearing member, said contact charging member being supplied only with a DC voltage;

a developing device that develops a toner image on said image bearing member with toner comprising an externally added material, wherein the externally added material comprises silica, wherein the silica on said contact charging member is charged to a negative polarity; and a contact member contacted to said contact charging member, wherein said contact member comprises one of polyimide containing biphenyl tetracarboxyl dianyhydride and polyphenylenesulfide, and wherein said contact member has a work function larger than a work function of the silica, and said contact charging member has a work function smaller than the work function of the silica, wherein the work function of said contact member is the amount of excitation energy that must be applied thereto to free an electron therefrom, wherein the work function of said contact charging member is the amount of excitation energy that must be applied thereto to free an electron therefrom, wherein the work function of the silica is the amount of excitation energy that must be applied thereto to free an electron therefrom, wherein the amount of excitation energy necessary to free an electron from said contact member is larger than the amount of excitation energy necessary to free an electron from the silica, and wherein the amount of excitation energy necessary to free an electron from said contact charging member is smaller than the amount of excitation energy necessary to free an electron from the silica.

10. An image forming apparatus comprising:

an image bearing member;

a charging device that electrically charges said image bearing member;

a latent image forming device that forms an electrostatic latent image on said electrically charged image bearing member;

a developing device that develops a toner image on said image bearing member with toner comprising an externally added material, wherein the externally added material comprises silica;

a transfeffing device that transfers a toner image formed on said image bearing member onto a recording material;

a cleaning device that removes the toner remaining on said image bearing member after transfer of the image, wherein said charging device includes a contact charging member contactable to said image bearing member to charge said image bearing member, said contact charging member being supplied oniy with a DC voltage, and a contact member contacted to said contact charging member, wherein said contact member comprises one of polyimide containing biphenyl tetracarboxyl dianyhydride and polyphenylenesulfide, wherein the silica on said contact charging member is charged to a negative polarity, and wherein said contact member has a work function larger than a work function of the silica, and said contact charging member has a work function smaller than the work function of the silica, wherein the work function of said contact member is the amount of excitation energy that must be applied thereto to free an electron therefrom, wherein the work function of said contact charging member is the amount of excitation energy that must be applied thereto to free an electron therefrom, wherein the work function of the silica is the amount of excitation energy that must be applied thereto to free an electron therefrom, wherein the amount of excitation energy necessary to free an electron from said contact member is larger than the amount of excitation energy necessary to free an electron from the silica, and wherein the amount of excitation energy necessary to free an electron from said contact charging member is smaller than the amount of excitation energy necessary to free an electron from the silica.

11. A charging device for electrically charging a image bearing member, comprising:

a contact charging member contactable to the image bearing member to charge the image bearing member, said contact charging member being supplied only with a DC voltage; and a contact member contacted to said contact charging member, wherein the image bearing member is adapted to carry a toner image of toner which contains an externally added material comprising silica, wherein the silica on said contact charging member is charged to a negative polarity, wherein said contact member has a work function larger than a work function of the silica, and said contact charging member has a work function smaller than the work function of the silica, and wherein an electric field is formed between said contact charging member and the image bearing member such that a negative potential of said contact charging member is higher than a potential of the image bearing member, wherein the work function of said contact member is the amount of excitation energy that must be applied thereto to free an electron therefrom, wherein the work function of said contact charging member is the amount of excitation energy that must be applied thereto to free an electron therefrom, wherein the work function of the silica is the amount of excitation energy that must be applied thereto to free an electron therefrom, wherein the amount of excitation energy necessary to free an electron from said contact member is larger than the amount of excitation energy necessary to free an electron from the silica, and wherein the amount of excitation energy necessary to free an electron from said contact charging member is smaller than the amount of excitation energy necessary to free an electron from the silica.

12. An apparatus according to claim 11, wherein the silica has a particle size smaller than that of the toner.

13. An apparatus according to claim 11, wherein said contact member is reciprocable in an axial direction of said contact charging member.

14. A process cartridge detachably mountable to a main assembly of an image forming apparatus, said process cartridge comprising:

an image bearing member;

a contact charging member contactable to said image bearing member to charge said image bearing member, said contact charging member being supplied only with a DC voltage;

a developing device that develops a toner image on said image bearing member with toner comprising an externally added material, wherein the externally added material comprises silica, wherein the silica on said contact charging member is charged to a negative polarity; and a contact member contacted to said contact charging member, wherein said contact member has a work function larger than a work function of the silica, and said contact charging member has a work function smaller than the work function of the silica, and wherein an electric field is formed between said contact charging member and said image bearing member such that a potential of said contact charging member is higher than a potential of said image bearing member in a direction toward a negative polarity, wherein the work function of said contact member is the amount of excitation energy that must be applied thereto to free an electron therefrom, wherein the work function of said contact charging member is the amount of excitation energy that must be applied thereto to free an electron therefrom, wherein the work function of the silica is the amount of excitation energy that must be applied thereto to free an electron therefrom, wherein the amount of excitation energy necessary to free an electron from said contact member is larger than the amount of excitation energy necessary to free an electron from the silica, and wherein the amount of excitation energy necessary to free an electron from said contact charging member is smaller than the amount of excitation energy necessary to free an electron from the silica.

15. An image forming apparatus comprising:

an image bearing member;

a charging device that electrically charges said image bearing member;

a latent image forming device that forms an electrostatic latent image on said electrically charged image bearing member;

a developing device that develops a toner image on said image bearing member with toner comprising an externally added material, wherein the externally added material comprises silica;

a transferring device that transfers a toner image formed on said image bearing member onto a recording material;

a cleaning device that removes the toner remaining on said image bearing member after transfer of the image, wherein said charging device includes a contact charging member contactable to said image bearing member to charge said image bearing member, said contact charging member being supplied only with a DC voltage, and a contact member contacted to said contact charging member, wherein the silica on said contact charging member is charged to a negative polarity, and wherein said contact member has a work function larger than a work function of the silica, and said contact charging member has a work function smaller than the work function of the silica, and wherein an electric field is formed between said contact charging member and said image bearing member such that a potential of said contact charging member is higher than a potential of said image bearing member in a direction toward a negative polarity, wherein the work function of said contact member is the amount of excitation energy that must be applied thereto to free an electron therefrom, wherein the work function of said contact charging member is the amount of excitation energy that must be applied thereto to free an electron therefrom, wherein the work function of the silica is the amount of excitation energy that must be applied thereto to free an electron therefrom, wherein the amount of excitation energy necessary to free an electron from said contact member is larger than the amount of excitation energy necessary to free an electron from the silica, and wherein the amount of excitation energy necessary to free an electron from said contact charging member is smaller than the amount of excitation energy necessary to free an electron from the silica.

16. A charging device according to claim 1, wherein the amount of excitation energy that must be applied to said contact member is at least 5% greater than the amount of excitation energy that must be applied to the silica.

* * * * *